United States Patent [19]

Semon

[11] Patent Number: 4,697,316

[45] Date of Patent: Oct. 6, 1987

[54] BURIAL CASKET WITH IDENTIFICATION CAPSULE

[75] Inventor: Joseph R. Semon, Eynon, Pa.

[73] Assignee: Casket Shells, Inc., Eynon, Pa.

[21] Appl. No.: 885,924

[22] Filed: Jul. 15, 1986

[51] Int. Cl.[4] ..... A61G 17/00; A61G 17/04

[52] U.S. Cl. ..... 27/1; 27/2; D99/8

[58] Field of Search ..... 27/1, 2, 19; D99/8, D99/15, 4, 1, 17, 99; D11/80

[56] References Cited

U.S. PATENT DOCUMENTS

| | | | |
|---|---|---|---|
| D 87,176 | 6/1932 | Treiber | D99/99 |
| D 278,609 | 4/1985 | Satterelli | D11/80 X |
| 331,982 | 12/1885 | Lovett | 27/2 |
| 983,963 | 2/1911 | Wetmore | 27/16 |
| 2,075,859 | 4/1937 | Martin | D99/17 X |
| 3,435,494 | 4/1969 | Bernard | D99/1 X |
| 4,324,026 | 4/1982 | Craft | 27/1 |

*Primary Examiner*—Robert A. Hafer
*Assistant Examiner*—Terrence L. B. Brown
*Attorney, Agent, or Firm*—Kane, Dalsimer, Kane, Sullivan and Kurucz

[57] ABSTRACT

A burial casket is provided with a capsule which extends from a casket side wall inwardly and contains information regarding the remains contained in the casket. The capsule is removable from the casket to give access to the information without opening the casket.

1 Claim, 5 Drawing Figures

48
47
42
26
44
46
49
60
28
50
54
52
56
58
62
64
20
72
75
66
70
74
68
76
30
24
32

14
36
40
38
32
24
34

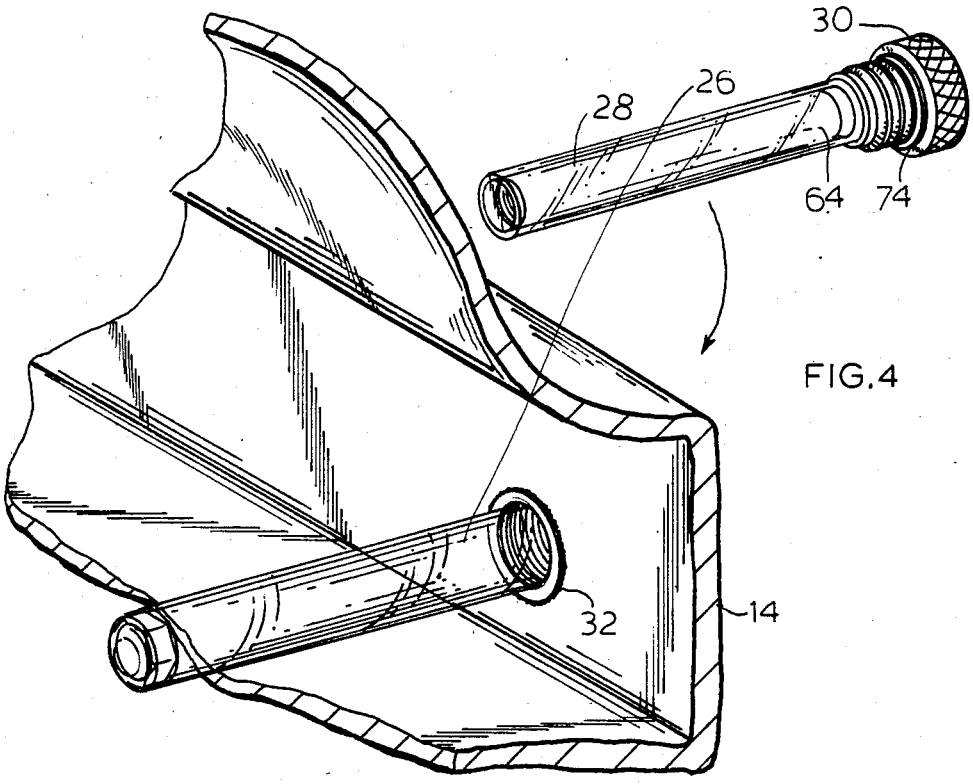
FIG.4
FIG.5
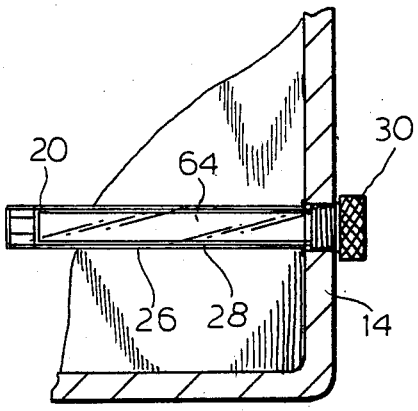

BURIAL CASKET WITH IDENTIFICATION CAPSULE

BACKGROUND OF THE INVENTION

1. Field of Invention

This invention pertains to a burial casket having a capsule for identifying the remains contained therein, which capsule is accessible from the outside.

2. Description of the Prior Art

It is frequently desirable to provide burial caskets with some form of identifying the remains contained therein either just prior to burial, or in some cases relatively long periods of time thereafter. Heretofore, such identification could only be provided either on the outside or the inside of the casket. If the identification was on the outside, it had to be firmly secured to the casket so that it would not be separated. Because of various psychological, emotional and religious factors, the external identification had to be aesthetically pleasing, solemn, and discrete and at the same time must be in a form that could withstand rather extreme physical conditions for a long period of time. Obviously, external identification means are usually expensive and require a long time to make.

Internal identification need not be so rugged as the external one, however it still must be able to withstand strong chemical action due to the decaying body, as well as normal oxidation for a long period of time. Furthermore, internal identification is sometimes objectionable on an emotional and psychological basis because it can be checked only by opening the casket.

OBJECTIVES AND SUMMARY OF THE INVENTION

It is a principal objective of the present invention to provide a casket with an identification member which is externally accessible yet is easy and inexpensive to make.

A further objective is to provide a casket with an identification means which is easy to inspect and yet normally unobtrusive.

Another objective is to provide a casket with an identification means which is unaffected by normal chemical action, over a long period of time.

Other objectives and advantages of the invention shall become apparent from the following description. In accordance with this invention, a casket is provided with a a plurality of walls defining an enclosure and a capsule for holding information, substantially disposed in said enclosure, said capsule being attached attached to one of said walls and being removable without opening said enclosure.

BRIEF DESCRIPTION OF THE FIGURES

FIG. 4 shows the capsule inner tube being inserted into the casket; and

FIG. 5 shows the inner tube of FIG. 4 in its final position.

DETAILED DESCRIPTION OF THE INVENTION

Figure 1:
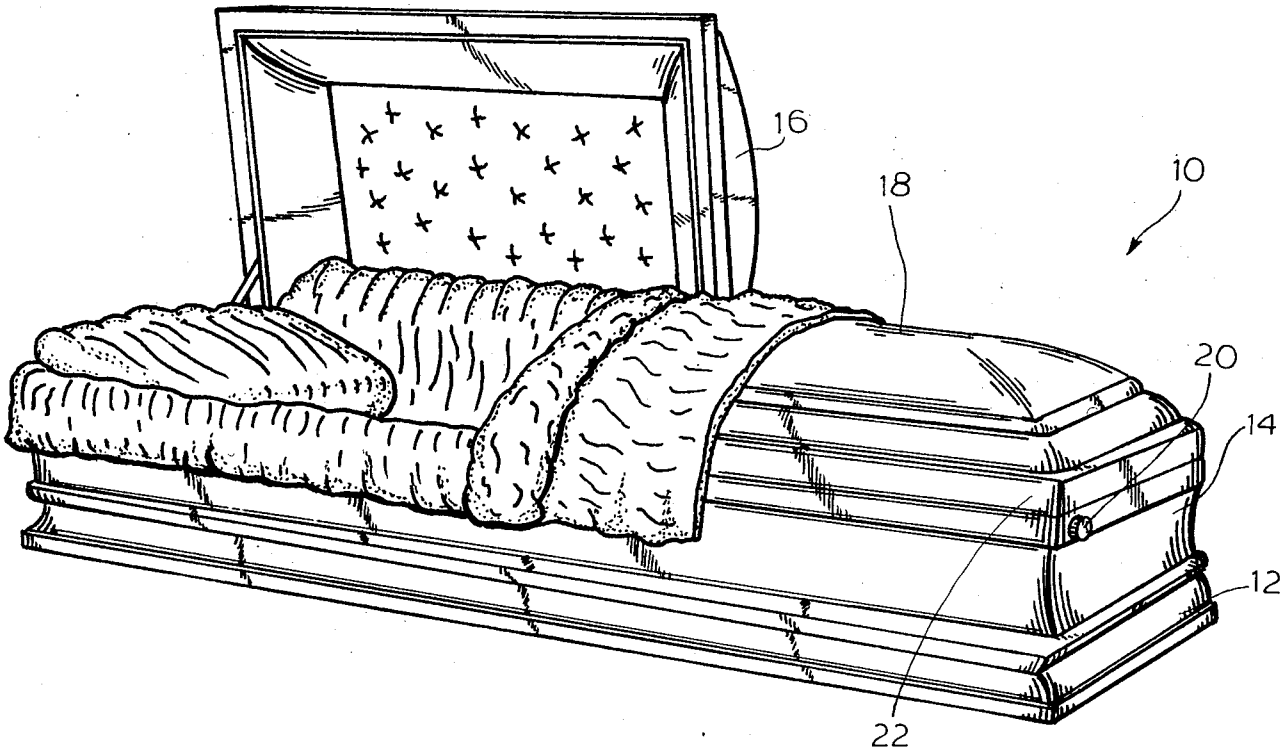
FIG. 1 shows a casket with an identification capsule constructed in accordance with this invention.

Referring now to the Figures, and more particularly to FIG. 1, a casket 10 includes a bottom wall 12, side walls 14 and hinged top walls 16,18. One of these walls, such as for example one of the side walls 14 is provided with a capsule 20. As shown in FIG. 1, it is preferable to place the capsule at or toward the foot of the casket adjacent to an upper casket corner 22 so that it is inconspicuous but easily accessible. Of course, this location should be standardized for all caskets.

Figure 2:
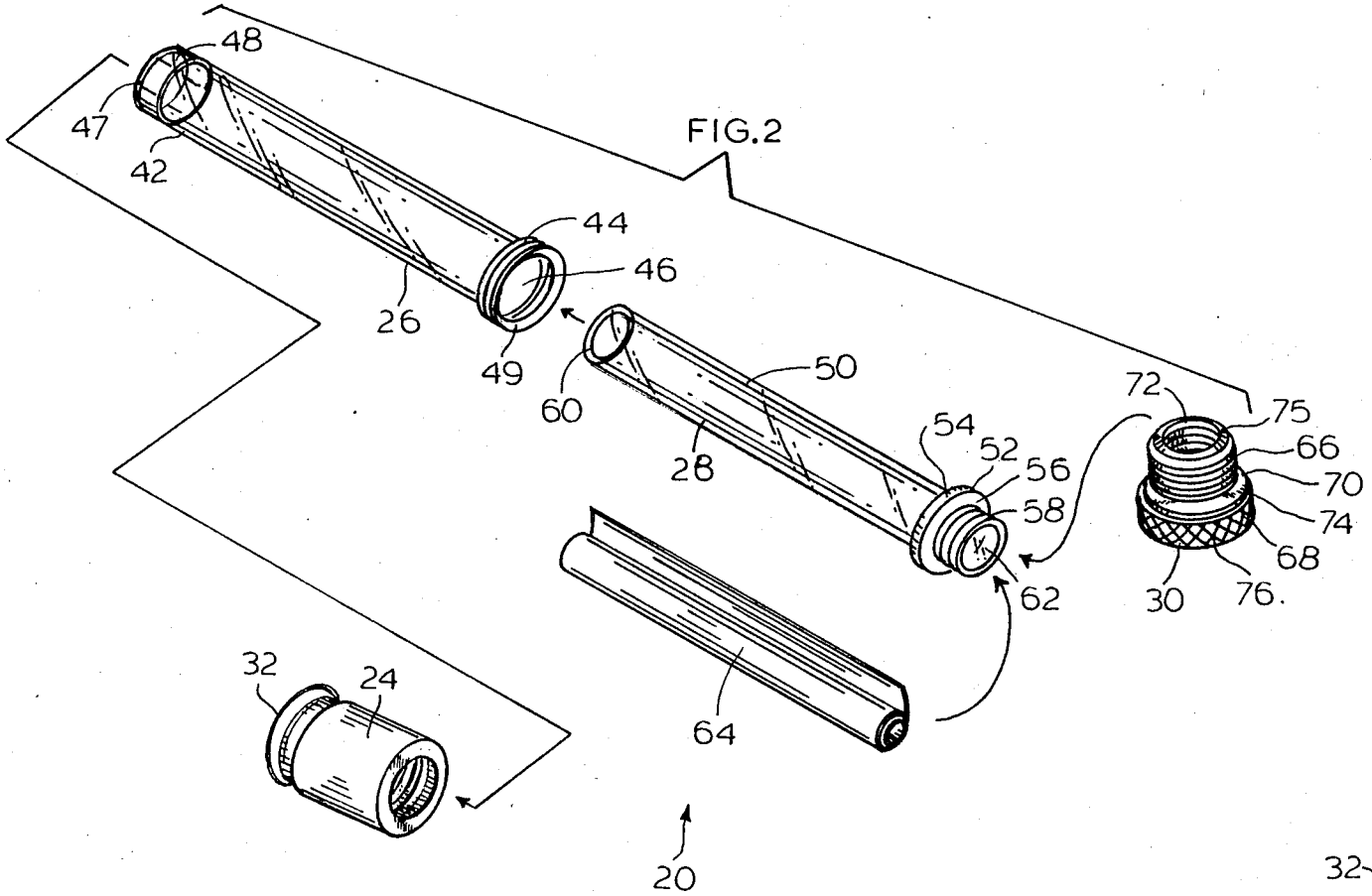
FIG. 2 shows an exploded view of the capsule incorporated in the casket of FIG. 1.
Figure 3:
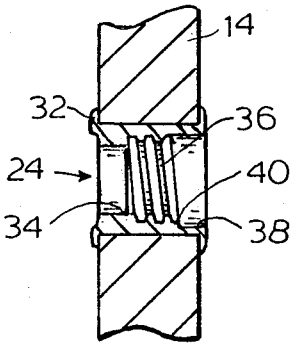
FIG. 3 shows the manner in which the capsule is affixed to the casket.

The individual elements of the capsule 20 are shown in FIG. 2. The capsule includes a sleeve 24, an outer tube 26, an inner tube 28 and a cap 30. Sleeve 24 is preferably made of galvanized metal or other relatively strong material which withstands corrosion. The sleeve has an axial length which conforms substantially to the thickness of side wall 14 and at one axial end, has an enlarged radial rim 32. As best shown in FIG. 3, the sleeve 24, has a first inner wall portion 34, adjacent rim 32, which is relatively smooth. Axially spaced from inner wall 34 there is a threaded portion 36, and a second inner wall portion 38 which is also relatively smooth but has a diameter which is larger than the diameter of first inner wall portion 34. A shoulder 40 is formed between inner wall portion 38 and threaded portion 36 as shown. As shown in FIG. 3, sleeve 24 passes through and is secured to casket side wall 14 to resist rotation, with rim 32 disposed inside the casket. Outer tube 26 has a cylindrical outside surface 42 which terminates at one end by an open threaded portion 44 which is adapted to engage the threads of sleeve portion 36. The tube 26 also has a substantially cylindrical inner surface 46 which terminates at a closed end 47 opposite threaded portion 44 with several reinforcing members 48 and open end 49.

Inner tube 28 included a cylindrical outer surface 50, and a rim 52 having two parallel, axially spaced shoulders 54 and 56. A threaded portion 58 is disposed axially adjacent to rim 52. Tube 26 is closed at end 60 and open at end 62. Inner tube 26 is adapted to hold a scroll or parchment 64 containing identification information. Preferably, one or both tubes 26, 28 are made of a transparent or translucent material such as a biologically inert plastic, i.e. a material which is not chemically affected by biological decomposition.

Finally, cap 30 comprises two axially spaced portions 66, 68. Preferably, cap 30, like sleeve 24, is made of a anti-corrosive material. Portion 66 has a threaded outer surface 70 which may be screwed into threaded sleeve portion 36, and a threaded inner surface 72 which accepts inner tube threaded portion 58. Cap portion 66 is preferably slightly longer than corresponding inner tube threaded portion 58 and ends in a rim 75. On outer surface 70 there is a provided a sealing O-ring 74 made of a resilient material. Cap portion 68 is provided with a knurled outer surface 76 so that cap 30 can be easily screwed or unscrewed.

The casket is assembled as follows. Sleeve 24 is first installed into side wall 14 so that it is securely attached thereto. Alternatively, a threaded hole corresponding to the inner wall portions 34, 36 and 38 shown in FIG. 3 is made in the side wall. Next, outer tube is screwed into the sleeve with the tube disposed substantially within the casket as shown in FIG. 4. The threaded portion 44 is advanced within the sleeve until it abuts inner wall portion 34. Scroll 64 is placed in inner tube 28, and cap 30 is then secured to the tube by screwing cap portion 72 into tube portion 58. Cap 30 is advanced until cap rim 75 contacts shoulder 56 on rib 52 thereby sealing tube 28. The inner tube 28 is then inserted into outer tube 26 (FIG. 4) and outer cap portion 70 is screwed into sleeve portion 36 until shoulder 54 contacts the center tube end 49 thereby sealing outer tube 26. Preferably, cap 30 is dimensioned so that just before shoulder 54 engages outer tube end 49, the resilient ring 74 disposed with annular space between the cap and sleeve wall portion 40 contacts sleeve shoulder 40. As the cap is tightened further the ring 74 further resiliently seals the capsule. Thus, in the final configuration of FIG. 5, the capsule is doubly sealed within the casket.

Scroll 64 may contain, biographical, medical or other type of information. Obviously, numerous improvements may be made to this invention without departing from its scope as defined in the appended claims.

What is claimed is:

1. A burial casket comprising:

a plurality of walls cooperating to form a closed enclosure, one wall having a hole providing access into said enclosure:

a capsule for holding information having a sleeve axially coextensive with and disposed within said hole; means for securing the sleeve to the said one wall, an outer tube extending away from said one wall and into said enclosure, said outer tube having a closed end and an open end, said open end adapted to open into said sleeve; means for securing outer tube to the sleeve, and an inner tube having a closed end and an open end disposed substantially within said outer tube; a cap secured to said inner tube and extending over the inner tube open end; said sleeve being at least partially internally threaded to define sleeve threads and said outer tube being provided with threads at said open end for engaging said sleeve threads; said cap being provided with outer threads for engaging said sleeve threads; said inner tube being provided with threads at said open end and said cap being provided with inner threads for engaging said inner tube threads to seal said inner tube; and said cap being arranged to seal both said outer and inner tubes.

* * * * *